US009976237B2

(12) United States Patent
Amis et al.

(10) Patent No.: US 9,976,237 B2
(45) Date of Patent: May 22, 2018

(54) SOCK WITH HEEL LOCATING FEATURES

(71) Applicant: NIKE, Inc., Beaverton, OR (US)

(72) Inventors: Hannah R. Amis, Portland, OR (US); Kenneth T. Craig, Beaverton, OR (US); David Malul, Beaverton, OR (US); Ronen Yehuda, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 112 days.

(21) Appl. No.: 15/150,560

(22) Filed: May 10, 2016

(65) Prior Publication Data

US 2016/0340813 A1 Nov. 24, 2016

Related U.S. Application Data

(60) Provisional application No. 62/163,171, filed on May 18, 2015.

(51) Int. Cl.

| | |
|---|---|
| ***A43B 13/18*** | (2006.01) |
| ***A43B 13/00*** | (2006.01) |
| ***D04B 1/26*** | (2006.01) |
| ***A41B 11/00*** | (2006.01) |

(52) U.S. Cl.

CPC ..... *D04B 1/26* (2013.01); *A41B 11/003* (2013.01)

(58) Field of Classification Search

CPC ... D04B 1/26; D04B 1/02; D04B 1/08; D04B 1/108; D04B 1/12; D04B 1/18; D04B 1/24; D04B 1/265; D04B 15/66; A41D 13/0015; A41D 13/05; A41D 1/00; A41D 13/06; A41D 2600/10; A41B 11/003; A41B 11/005; A41B 11/00; A41B 11/10; A41B 2400/32; A41B 2400/38; A41B 2500/10; A43B 23/07; A43B 13/188; A43B 23/088; A43B 1/00; A43B 1/0027; A63B 2071/1275; A63B 71/1225

See application file for complete search history.

(56) References Cited

U.S. PATENT DOCUMENTS

| | | | |
|---|---|---|---|
| 2,050,535 | A | 8/1936 | Martel et al. |
| 3,098,369 | A | 7/1963 | Burleson et al. |
| D254,101 | S | 2/1980 | Gilbert |
| 5,103,656 | A | 4/1992 | Hanson, II et al. |
| 5,617,745 | A | 4/1997 | Della Corte et al. |
| D392,795 | S | 3/1998 | Ogden |

(Continued)

FOREIGN PATENT DOCUMENTS

| | | | |
|---|---|---|---|
| CN | 201303594 | | 9/2009 |
| JP | 4447559 | B2 | 4/2010 |
| WO | 2007147980 | A2 | 12/2007 |

OTHER PUBLICATIONS

International Search Report and Written Opinion dated May 16, 2016 in International Patent Application No. PCT/US2016/032673, 19 pages.

*Primary Examiner* — Bobby Muromoto, Jr.

(74) *Attorney, Agent, or Firm* — Shook, Hardy & Bacon L.L.P.

(57) ABSTRACT

A knit garment having locating features is provided. A first knit area of the garment is spaced from a second knit area. A knit locating feature is disposed between the first and the second areas. This locating feature is defined by an elastic border that surrounds a knit pocket that is less elastic than the border.

19 Claims, 9 Drawing Sheets

(56) References Cited

U.S. PATENT DOCUMENTS 6,708,348 B1 3/2004 Romay
D489,887 S 5/2004 Mavis et al.
6,805,681 B2 10/2004 Yokoyama
7,346,936 B2 3/2008 Vargas et al.
D590,590 S 4/2009 Bonzagni et al.
D613,491 S 4/2010 Hollingsworth et al.
7,765,719 B2 * 8/2010 Nurse ..... A41B 11/10 36/144
D623,761 S 9/2010 Chiang
D623,762 S 9/2010 Chiang
D623,763 S 9/2010 Chiang
D624,300 S 9/2010 Hollingsworth et al.
7,941,869 B2 * 5/2011 Wright ..... A41D 13/05 2/239
D641,148 S 7/2011 Kent
7,971,280 B2 7/2011 Kaneda
7,996,924 B2 * 8/2011 Wright ..... A41D 13/0015 2/239
8,051,582 B2 * 11/2011 Nurse ..... A41B 11/10 36/144
D650,969 S 12/2011 Wong
D655,909 S 3/2012 Yoe, III et al.
8,347,413 B2 * 1/2013 Wright ..... A41D 13/05 2/239
8,495,765 B2 7/2013 Araki et al.
D691,789 S * 10/2013 Caruthers ..... D2/985
8,572,766 B2 * 11/2013 Shull ..... A41B 11/003 2/239
8,590,178 B2 * 11/2013 Avar ..... A43B 3/0036 36/10
D696,509 S * 12/2013 Caruthers ..... D2/985
D700,430 S * 3/2014 Frederick ..... D2/994
D700,431 S * 3/2014 Frederick ..... D2/994
D702,934 S * 4/2014 Frederick ..... D2/994
D703,427 S * 4/2014 Frederick ..... D2/994
D710,593 S 8/2014 Goodman et al.
8,918,917 B2 * 12/2014 Nordstrom ..... A41D 13/0015 2/239
D740,014 S * 10/2015 Amis ..... D2/980
9,162,142 B2 * 10/2015 Shum ..... A63F 13/06
D743,689 S * 11/2015 Amis ..... D2/994
D744,741 S * 12/2015 Amis ..... D2/980
D746,580 S * 1/2016 Amis ..... D2/980
9,365,960 B2 * 6/2016 Craig ..... D04B 1/26
9,380,831 B2 * 7/2016 Craig ..... A41B 11/02
9,498,023 B2 * 11/2016 Criag ..... A43B 1/04
D773,798 S * 12/2016 Amis ..... D2/994
9,622,518 B2 * 4/2017 Wright ..... A41D 13/0015
D799,198 S * 10/2017 Amis ..... D2/994
2003/0191419 A1 * 10/2003 Melin ..... A61F 15/004 602/3
2003/0230121 A1 * 12/2003 Yokoyama ..... A41B 11/003 66/178 A
2006/0057376 A1 * 3/2006 O'Mara, Jr. ..... D01D 5/253 428/364
2007/0094892 A1 * 5/2007 Craig ..... A41B 11/02 36/10
2007/0106354 A1 * 5/2007 Carstens ..... A41D 13/1161 607/112
2007/0271820 A1 * 11/2007 Nurse ..... A41B 11/10 36/43
2008/0189825 A1 * 8/2008 Wright ..... A41D 13/05 2/69
2008/0295216 A1 * 12/2008 Nordstrom ..... A41D 13/0015 2/69
2008/0295230 A1 * 12/2008 Wright ..... A41D 13/0015 2/455
2008/0313824 A1 * 12/2008 Calvano ..... A43B 3/0031 12/146 B
2009/0165190 A1 * 7/2009 Araki ..... A61F 13/064 2/240
2009/0223254 A1 9/2009 Ishida
2009/0276939 A1 * 11/2009 Sho ..... A41B 11/02 2/239
2010/0186255 A1 * 7/2010 Avar ..... A43B 3/0036 36/10
2010/0199406 A1 * 8/2010 Dua ..... A43B 1/04 2/115
2010/0269244 A1 * 10/2010 Nurse ..... A41B 11/10 2/239
2011/0107501 A1 * 5/2011 Kawahara ..... A41B 11/02 2/239
2011/0265252 A1 * 11/2011 Craig ..... A41B 11/01 2/239
2011/0271423 A1 * 11/2011 Wright ..... A41D 13/0015 2/239
2012/0102625 A1 5/2012 Klein
2012/0180195 A1 7/2012 Shull
2012/0192334 A1 * 8/2012 Wright ..... A41D 13/05 2/69
2012/0266362 A1 * 10/2012 Craig ..... D04B 1/26 2/239
2013/0133123 A1 * 5/2013 Wright ..... A41D 13/05 2/69
2013/0312159 A1 * 11/2013 Nordstrom ..... A41D 13/0015 2/239
2014/0059743 A1 * 3/2014 Wright ..... A41D 13/0015 2/239
2014/0101824 A1 * 4/2014 Spanks ..... A43B 17/18 2/239
2014/0137434 A1 * 5/2014 Craig ..... A43B 1/04 36/54
2014/0259260 A1 * 9/2014 Behrend ..... A41D 13/05 2/22
2014/0317833 A1 * 10/2014 Craig ..... A41B 11/00 2/239
2014/0331387 A1 11/2014 Hennings
2015/0282564 A1 * 10/2015 Meschter ..... A43B 23/227 36/45
2015/0282565 A1 * 10/2015 Kilgore ..... A43B 23/227 36/45
2016/0076176 A1 * 3/2016 Rock ..... D04B 1/24 428/197
2016/0278441 A1 * 9/2016 Craig ..... D04B 1/26
2016/0295962 A1 * 10/2016 Craig ..... A41B 11/02
2016/0340813 A1 * 11/2016 Amis ..... D04B 1/26
2017/0027284 A1 * 2/2017 Craig ..... A43B 1/04

* cited by examiner

SOCK WITH HEEL LOCATING FEATURES

CROSS-REFERENCE TO RELATED APPLICATIONS

This application claims benefit of U.S. Provisional Application No. 62/163,171, filed May 18, 2015, entitled "Sock With Heel Locating Features" the entire disclosure of which is hereby incorporated by reference.

TECHNICAL FIELD

The present disclosure relates to garments, such as socks or sleeves, particularly to garments with locating or retaining features. More particularly, the present disclosure relates to a sock having heel locating and sole traction features, and a sleeve having similar locating features.

BACKGROUND

Various styles of socks are now available. One function of a sock is to mitigate the friction between the foot and the shoe. In achieving this function, it is desirable to maintain the relationship between the foot and the sock, to mitigate any abrasion caused by rubbing between the shoe, sock, and foot. The heel portion of a sock is often subjected to the most movement, as the user's heel moves with respect to the heel area of the shoe. Properly locating and retaining the user's foot with respect to the sock is a desirable feature. Similar concerns exist for other garments.

Commercially manufactured socks are produced using circular knitting machines. These machines employ needles mounted on a cylinder, or sometimes a double cylinder. The cylinder spins and the needles interlock loops of yarn. When the knitting process is complete, the sock appears as a tube that is open on both ends. The toe end of the sock is typically finished in a sewing or stitching operation. The sock described below is manufactured on these circular knitting machines.

BRIEF SUMMARY

This Summary provides a high-level overview of the disclosure and introduces a selection of concepts that are further described in the Detailed Description below. This Summary is not intended to identify key features or essential features of the claimed subject matter, nor is it intended to be used as an aid in isolation to determine the scope of the claimed subject matter.

Aspects herein generally relate to a knit garment having locating features. A first knit area of the garment is spaced from a second knit area. A knit locating feature is disposed between the first and the second areas. This locating feature is defined by an elastic border that surrounds a knit pocket that is less elastic than the border. Aspects also relate to a sock with a toe area, a foot area extending rearwardly from the toe area, and a heel area. The heel area extends from the foot area and is located to correspond to the heel of a user when the sock is worn. The heel area has an elastic border that substantially surrounds a heel pocket that is less elastic that the elastic border.

Additional objects, advantages, and novel features of the invention will be set forth in part in the description which follows, and in part will become apparent to those skilled in the art upon examination of the following, or may be learned by practice of the invention.

BRIEF DESCRIPTION OF THE DRAWINGS

The present invention is described in detail below with reference to the attached drawing figures, which are incorporated herein by reference, wherein.

DETAILED DESCRIPTION

The subject matter of aspects of the present invention is described with specificity herein to meet statutory requirements. But the description itself is not intended to necessarily limit the scope of the claims. Rather, the claimed subject matter might be embodied or carried out in other ways to include different elements or combinations of elements similar to the ones described in this document, in conjunction with other present or future technologies.

Figure 1:
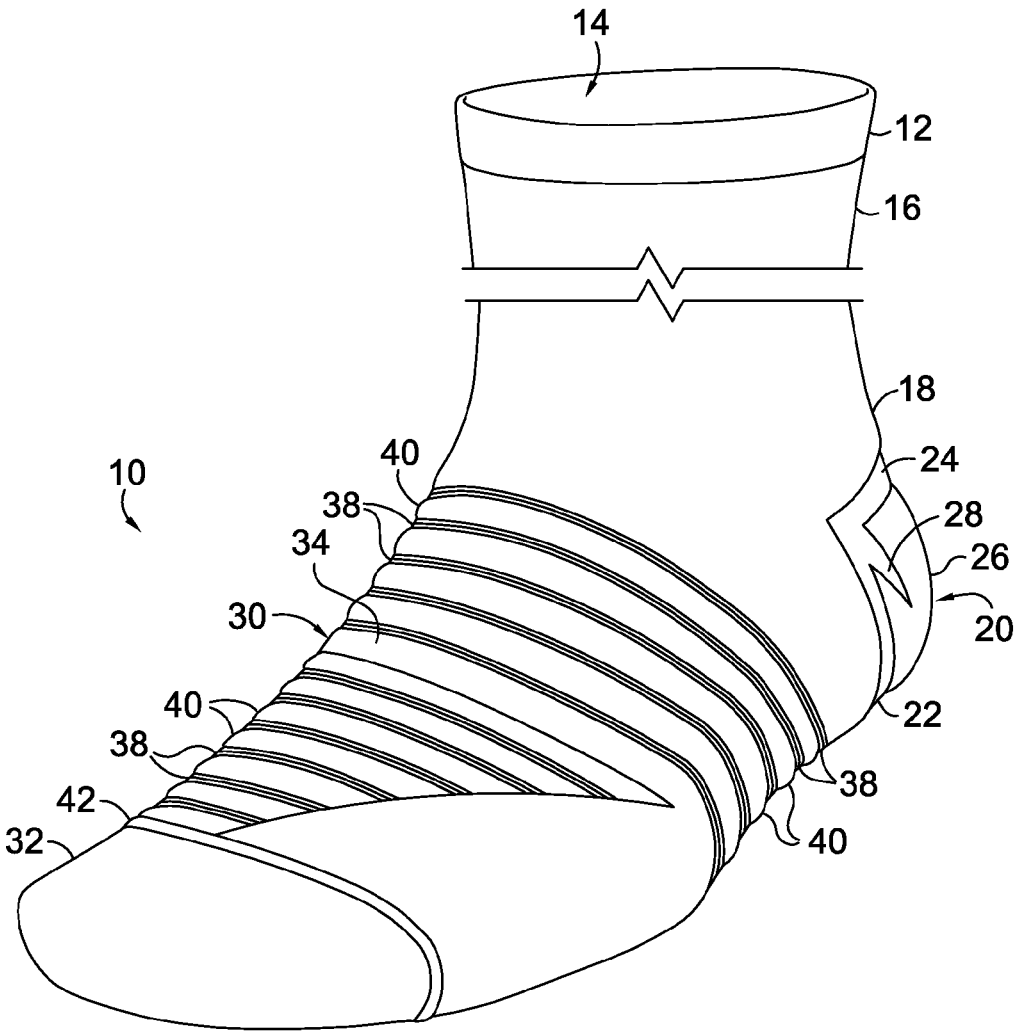
FIG. 1 is a perspective view of an exemplary left sock illustrating some aspects of the disclosure.
Figure 2:
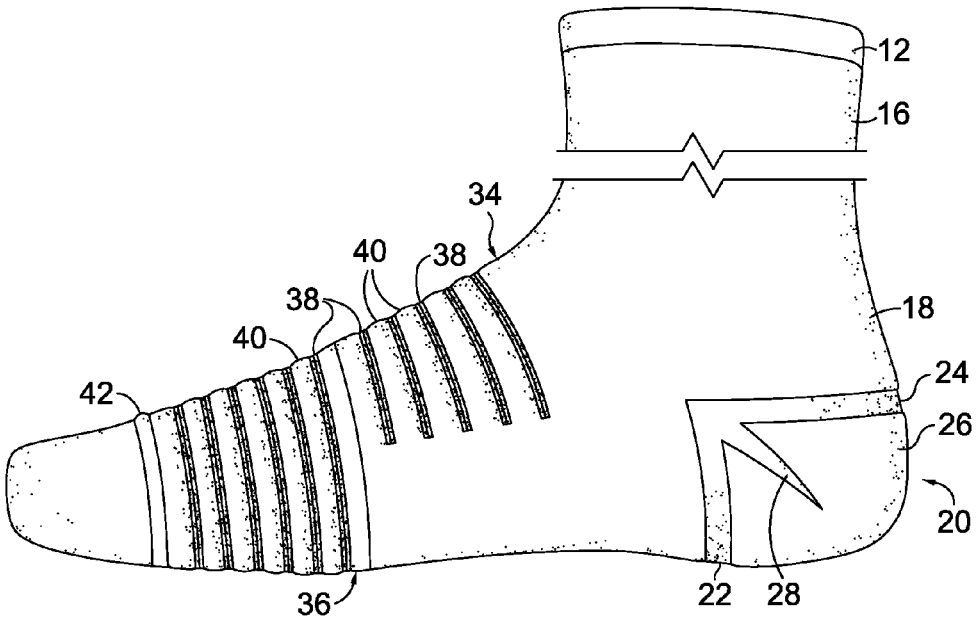
FIG. 2 shows a medial side view of the sock of FIG. 1.
Figure 3:
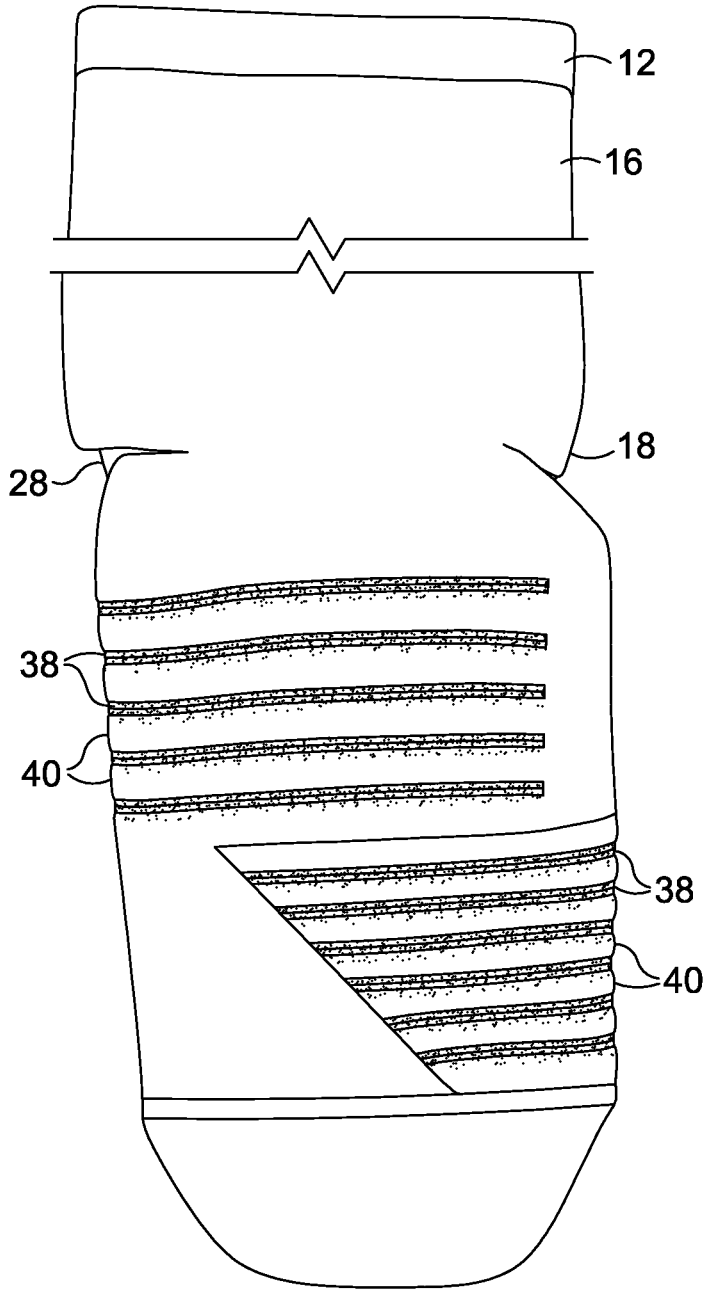
FIG. 3 is a top view of a right-foot version of the sock of FIG. 1, shown in an unworn, laid flat condition.
Figure 4:
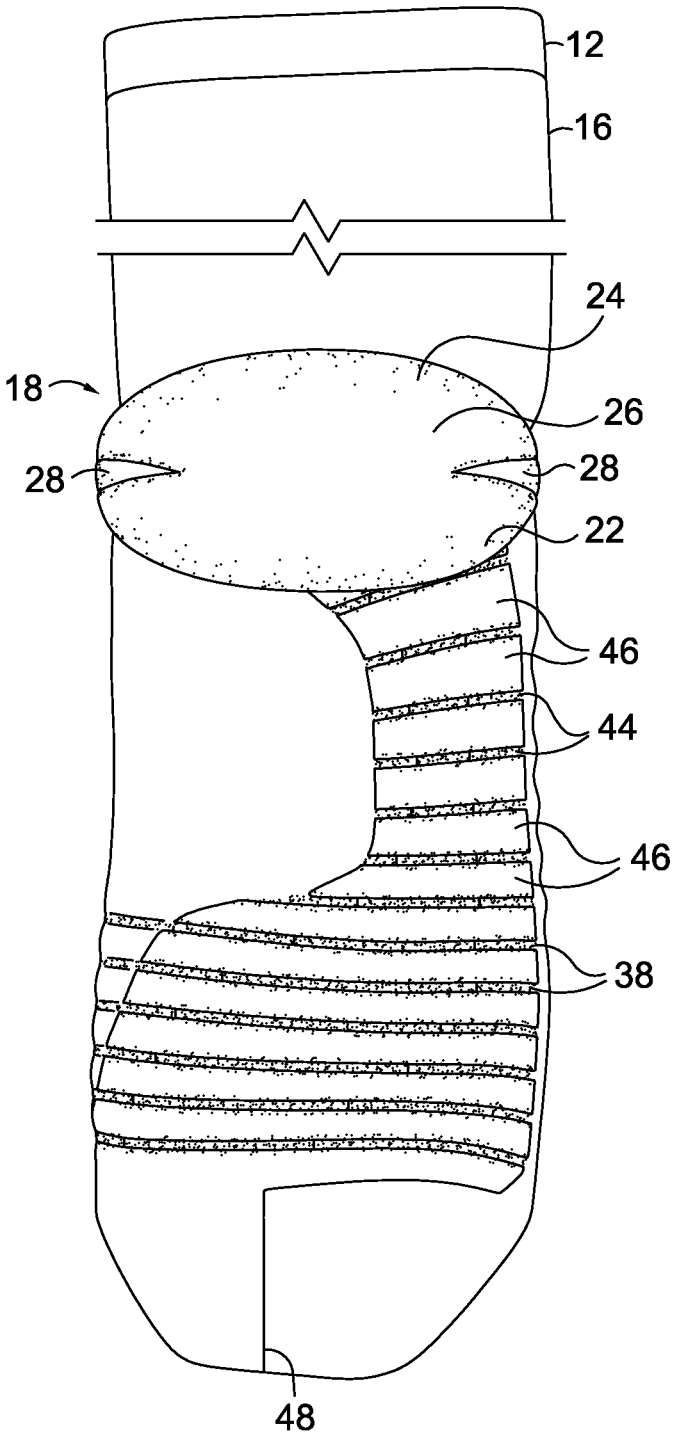
FIG. 4 is a bottom view of a right-foot version of the sock of FIG. 1, shown in an unworn, laid flat condition.

In general, this disclosure relates to a garment having features that more securely locate the garment in a desired location relative to a wearer's body and retain it in position. Referring initially to FIG. 1, a left sock 10 is depicted that is made using a circular knitting machine. The left sock 10 is shown in FIGS. 1 and 2, while the right sock 10 is shown in FIGS. 3 and 4. The left and right socks 10 are mirror images of one another. The sock 10 includes an upper cuff 12 that defines a circular opening 14, through which a user can insert her foot when donning the sock. A leg region 16 extends downwardly from the cuff 12, and an ankle region 18 extends below the leg region. Depending on the sock type, the leg region 16 varies in height. For example, for a boot length sock 10, the leg region 16 would extend higher than a crew length sock 10. In some aspects, the sock 10 can be made as a no-show sock, where the leg region 16 is omitted, and the sock transitions from the cuff 12 to the ankle region 18. Other sock types, such as, for example, quarter length and over-the-calf, are also possible, and this disclosure is not limited to any particular sock type.

Sock 10 further has a heel area 20 that is preferably knit as a true heel pocket. Heel area 20 is defined by a first elastic band 22 that extends generally vertically (as viewed in FIGS. 1 and 2) from the bottom of sock 10, and a second elastic band 24 that extends from the back of the sock 10 horizontally (as viewed in FIGS. 1 and 2). In aspects, the first and second elastic bands meet and form a substantially right angle. The first elastic band 22 extends across the bottom of the sock 10, forming a U-shape, such that it extends from one side of the sock 10 to the other. Somewhat similarly, the second elastic band 24 extends across the back of sock 10, forming a U-shape, such that it extends from one side of the sock 10 to the other. In aspects, the "open" ends of the two U-shapes converge and meet to form the substantially right angle. In exemplary aspects, the first and second elastic bands are the same width, with one exemplary width being 9 mm. However, the first and second bands could also have widths different from one another, and could vary in width. The first and second elastic bands 22 and 24 define a heel pocket 26 that is knit from a generally non-elastic yarn. In aspects, the heel pocket 26 is knit with an increased thickness for added comfort. When the heel pocket 26 is formed, a line is created called the gore line that runs diagonally through the heel, and is formed by stitches in the sock that are knit, and other stitches that are held in position without stitching. In some aspects, heel area 20 further has a third elastic band 28 that extends into the heel pocket 26, generally along the gore line of the heel pocket 26. In aspects, the third elastic band 28 has a tapering width that terminates in a point. Like first and second elastic bands 22, 24, third elastic band 28 may have an initial exemplary width of 9 mm that tapers to form a point, although other widths are within the scope of this disclosure. Additionally, although the third elastic band 28 is shown with a tapering width, other shapes could also be used. The third elastic band 28 could also be shorter, or longer, than the band 28 depicted in FIGS. 1-4. Any of a number of elastomeric yarns could be used for first, second, and third elastic bands 22, 24, and 28, and different yarns could be used for each band, although in some aspects the same elastomeric yarn is used for all of bands 22, 24, and 28. Further, the elasticity of the bands 22, 24, and 28 merely needs to be greater than the elasticity of the heel pocket 26 and ankle region 18.

Elastic bands 22, 24, and 28 cooperate to properly position the heel area 20 of sock 10 on the wearer's foot, and cooperate to retain the heel area 20 of the sock 10 relative to the wearer's foot while the sock is worn. In other words, the elastic bands 22, 24, and 28 aid in preventing the heel area 20 of sock 10 from slipping relative to the wearer's heel.

Sock 10 further includes a foot region 30 that extends in the typical cylindrical fashion, terminating in a toe region 32. Generally, the toe region 32 is closed in a secondary sewing or stitching operation to complete the sock 10, as illustrated by the seam 42. The foot region 30 includes a top side 34 and a bottom side 36 oriented to surround the top and bottom of a wearer's foot, respectively. As best seen in FIG. 1, the top side 34 is formed with spaced elastic strips 38 separated by non-elastic bands 40. In one aspect, as shown, strips 38 and bands 40 are formed in spaced, parallel relationship. The term "elastic" is used here to define the relative elasticity between strips 38 having more elasticity than bands 40. In other words, while bands 40 may have some elasticity, the strips 38 are more elastic than bands 40. The separated areas of elasticity formed by strips 38 function to provide added traction to sock 10 and aid in keeping the sock 10 in place on the foot of the wearer. As best seen in FIGS. 1 and 2, in aspects, the strips 38 and bands 40 may extend from the top side 34 to the bottom side 36 in some areas. In other aspects, the bottom side 36 has separate, non-continuous elastic strip segments 44 and spaced non-elastic band segments 46 that extend only partially across the bottom of the sock 10, generally along the lateral portion of the bottom of the sock 10. The portions of non-elastic bands 40 on the bottom of the sock 10 and the non-elastic band segments 46 may have an increased thickness, relative to elastic strips 38 and elastic strip segments 44. This alternating, spaced pattern of elastic strips/strip segments 38, 44 and non-elastic band/band segments 40, 46 adds to the traction of sock 10 and aids in keeping sock 10 in place on the wearer's foot. As best seen in FIG. 4, the underside of the toe area 32 may be finished with an additional toe seam 48.

Figure 5:
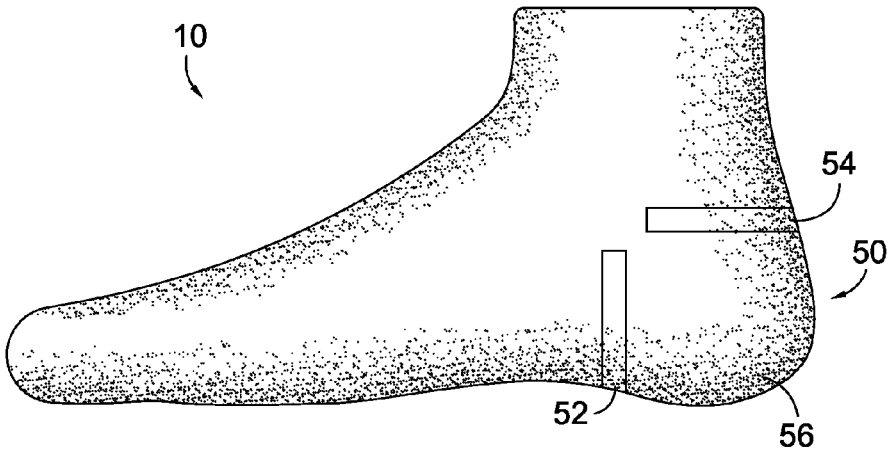
FIG. 5 shows an alternate heel construction in accordance with an aspect hereof.

FIGS. 5-8 show aspects of sock 10 with alternate heel constructions. The remainder of the sock 10 of FIGS. 5-8 is typically similar to that described above with respect to FIGS. 1-4. Therefore, only the details of the alternate heel constructions are shown in FIGS. 5-8. As best seen in FIG. 5, a sock 10 with an alternative heel area 50 is shown. In this aspect, heel area 50 is defined by a first elastic band 52 that extends generally vertically from the bottom of sock 10, and a second elastic band 54 that extends from the back of the sock 10 horizontally. In this exemplary aspect, the first and second elastic bands do not meet, leaving a gap between the terminal ends of the first and second elastic bands 52 and 54. The first elastic band 52 extends across the bottom of the sock 10, forming a U-shape, such that it extends from one side of the sock 10 to the other. Somewhat similarly, the second elastic band 54 extends across the back of sock 10, forming a U-shape, such that it extends from one side of the sock 10 to the other. In this exemplary aspect, the "open" ends of the two U-shapes converge but do not meet. In exemplary aspects, the first and second elastic bands are the same width, with one exemplary width being 9 mm. However, the first and second bands could also have widths different from one another, and could vary in width and could taper at their terminal ends. The first and second elastic bands 52 and 54 define a heel pocket 56 that is knit from a generally non-elastic yarn. In aspects, the heel pocket 56 is knit with an increased thickness for added comfort. Any of a number of elastomeric yarns could be used for first and second bands 52 and 54, and different yarns could be used for each. As with the aspect described above, the elasticity of the bands 52 and 54 merely needs to be greater than the elasticity of the heel pocket 56.

Figure 6:
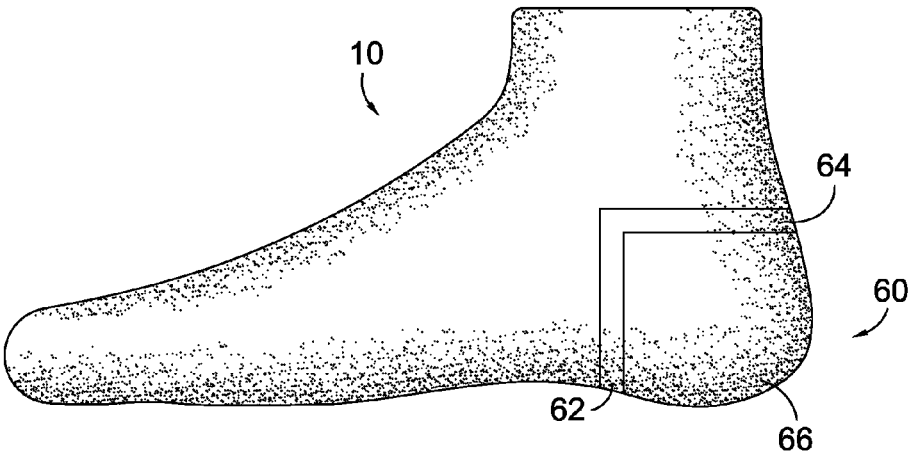
FIG. 6 shows an alternate heel construction in accordance with an aspect hereof.

As best seen in FIG. 6, a sock 10 with another alternative heel area 60 is shown. In this aspect, heel area 60 is defined by a first elastic band 62 that extends generally vertically from the bottom of sock 10, and a second elastic band 64 that extends from the back of the sock 10 horizontally. In this exemplary aspect, the first and second elastic bands meet at the terminal ends of the first and second elastic bands 62 and 64. Essentially, this aspect is somewhat similar to that depicted in FIGS. 1-4, without the third elastic band 28.

Figure 7:
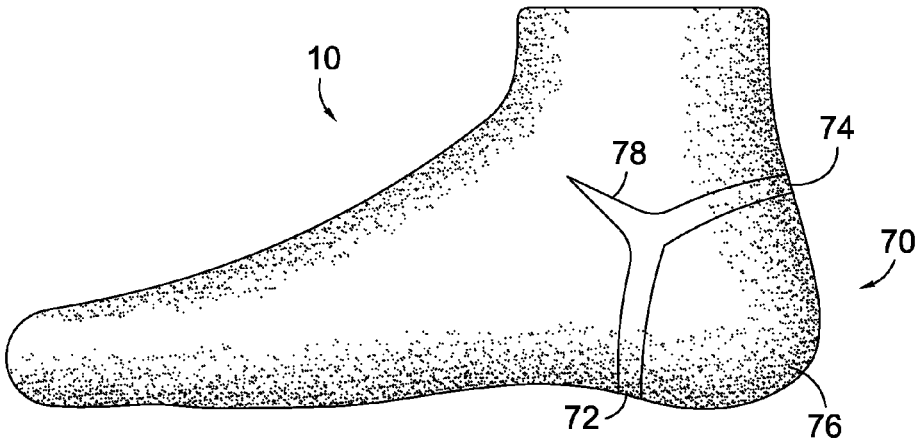
FIG. 7 shows an alternate heel construction in accordance with an aspect hereof.

As best seen in FIG. 7, a sock 10 with another alternative heel area 70 is shown. In this aspect, heel area 70 is defined by a first elastic band 72 that extends generally vertically from the bottom of sock 10, and a second elastic band 74 that extends from the back of the sock 10 horizontally. The first elastic band 72 extends across the bottom of the sock 10, forming a U-shape, such that it extends from one side of the sock 10 to the other. Somewhat similarly, the second elastic band 74 extends across the back of sock 10, forming a U-shape, such that it extends from one side of the sock 10 to the other. In this exemplary aspect, the "open" ends of the two U-shapes converge and meet at the terminal ends thereof. In exemplary aspects, the first and second elastic bands are the same width, with one exemplary width being 9 mm. However, the first and second bands could also have widths different from one another, and could vary in width. In exemplary aspects, first and second elastic bands 72 and 74 form more of an obtuse angle, as compared to the aspects shown in FIGS. 1-6. The first and second elastic bands 72 and 74 define a heel pocket 76 that is knit from a generally non-elastic yarn. In aspects, the heel pocket 76 is knit with an increased thickness for added comfort. Any of a number of elastomeric yarns could be used for first and second bands 72 and 74, and different yarns could be used for each. As with the aspects described above, the elasticity of the bands 72 and 74 merely needs to be greater than the elasticity of the heel pocket 76. In this exemplary aspect, heel area 70 further has a third elastic band 78 that extends away from the heel pocket 76, oriented generally in-line with the gore line of the heel pocket 76. In aspects, the third elastic band 78 has a tapering width that terminates in a point Like first and second elastic bands 72 and 74, third elastic band 78 may have an initial exemplary width of 9 mm, although other widths are within the scope of this disclosure. Additionally, although the third elastic band 78 is shown with a tapering width, other shapes could also be used. The third elastic band 78 could also be shorter, or longer, than the band 78 depicted in FIG. 7. Any of a number of elastomeric yarns could be used for first, second, and third elastic bands 72, 74, and 78, and different yarns could be used for each band, although in some aspects the same elastomeric yarn is used for all of bands 72, 74, and 78. Further, the elasticity of the bands 72, 74, and 78 merely needs to be greater than the elasticity of the heel pocket 76.

Figure 8:
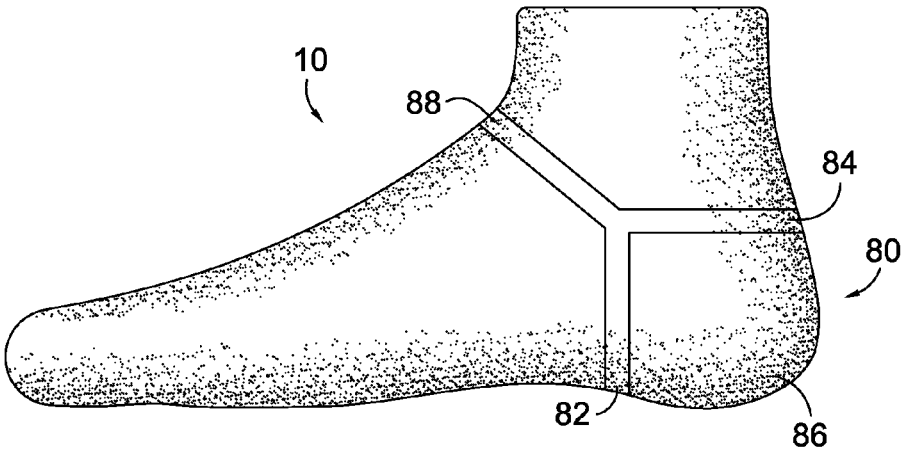
FIG. 8 shows an alternate heel construction in accordance with an aspect hereof.

As best seen in FIG. 8, a sock 10 with another alternative heel area 80 is shown. In this aspect, heel area 80 is defined by a first elastic band 82 that extends generally vertically from the bottom of sock 10, and a second elastic band 84 that extends from the back of the sock 10 horizontally. The first elastic band 82 extends across the bottom of the sock 10, forming a U-shape, such that it extends from one side of the sock 10 to the other. Somewhat similarly, the second elastic band 84 extends across the back of sock 10, forming a U-shape, such that it extends from one side of the sock 10 to the other. In this exemplary aspect, the "open" ends of the two U-shapes converge and meet at the terminal ends thereof. In exemplary aspects, the first and second elastic bands are the same width, with one exemplary width being 9 mm. However, the first and second bands could also have widths different from one another, and could vary in width. In exemplary aspects, first and second elastic bands 82 and 84 generally form a right angle. The first and second elastic bands 82 and 84 define a heel pocket 86 that is knit from a generally non-elastic yarn. In aspects, the heel pocket 86 is knit with an increased thickness for added comfort. Any of a number of elastomeric yarns could be used for first and second bands 82 and 84, and different yarns could be used for each. As with the aspects described above, the elasticity of the bands 82 and 84 merely needs to be greater than the elasticity of the heel pocket 86. In this exemplary aspect, heel area 80 further has a third elastic band 88 that extends away from the heel pocket 86, oriented generally in-line with the gore line of the heel pocket 86. In aspects, the third elastic band 88 extends from one side of sock 10 to the other. In other words, the third elastic band 88 extends from the intersection point of bands 82 and 84 on one side, to the intersection point of bands 82 and 84 on the other side. Like first and second elastic bands 82 and 84, third elastic band 88 may have an initial exemplary width of 9 mm, although other widths are within the scope of this disclosure. Any of a number of elastomeric yarns could be used for first, second, and third elastic bands 82, 84, and 88, and different yarns could be used for each band, although in some aspects the same elastomeric yarn is used for all of bands 82, 84, and 88. Further, the elasticity of the bands 82, 84, and 88 merely needs to be greater than the elasticity of the heel pocket 86.

The orientation of the elastic bands forming heel pockets 56, 66, 76, and 86 cooperate to properly position the respective heel area of sock 10 on the wearer's foot, and cooperate to retain the heel areas of the sock 10 relative to the wearer's foot while the sock is worn. In other words, the elastic bands forming heel pockets 56, 66, 76, and 86 aid in preventing the heel area of sock 10 from slipping relative to the wearer's heel.

Figure 9:
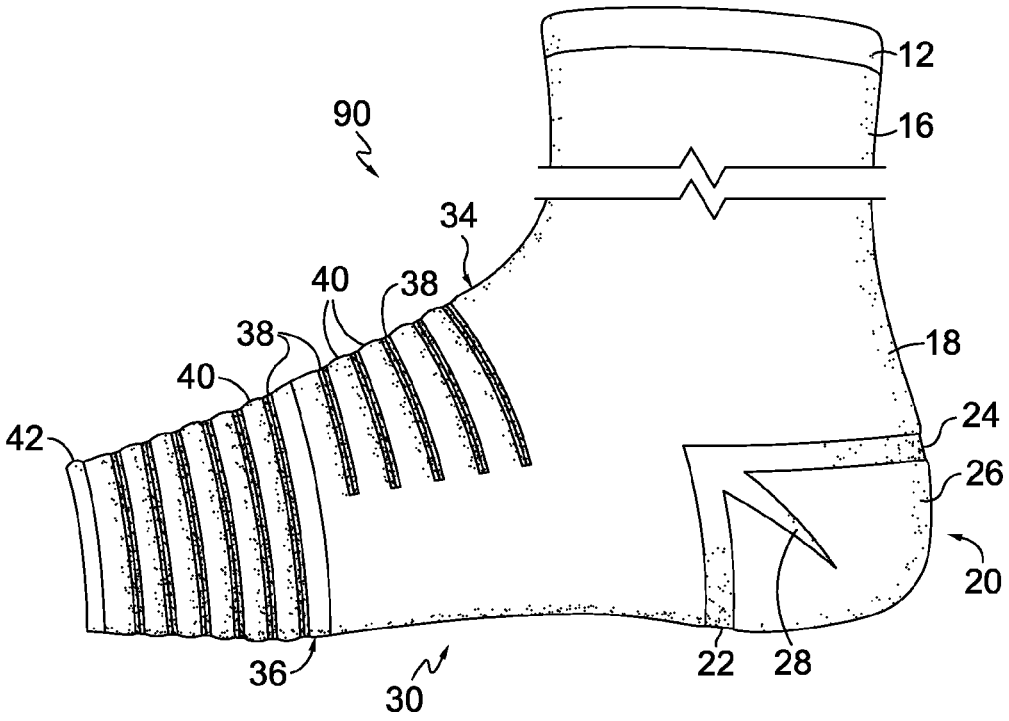
FIG. 9 shows a view similar to FIG. 2, but showing an alternative aspect.

FIG. 9 depicts an alternative construction. In many respects, the construction shown in FIG. 9 is similar to that shown in FIG. 2. But, FIG. 9 shows a bootie type construction 90, terminating such that seem 42 forms an open front end, through which a wearer's toes might extend. Bootie 90 is also made using a circular knitting machine. Like sock 10, bootie 90 includes an upper cuff 12 that defines a circular opening 14, through which a user can insert her foot when donning the bootie. A leg region 16 extends downwardly from the cuff 12, and an ankle region 18 extends below the leg region. Depending on the bootie type, the leg region 16 varies in height, including being so short as to form a "no-show" type bootie.

Bootie 90 further has a heel area 20. Heel area 20 is defined by a first elastic band 22 that extends generally vertically (as viewed in FIG. 9) from the bottom of bootie 90, and a second elastic band 24 that extends from the back of the bootie 90 horizontally (as viewed in FIG. 9). In aspects, the first and second elastic bands meet and form a substantially right angle. The first elastic band 22 extends across the bottom of the bootie 90, forming a U-shape, such that it extends from one side of the bootie 90 to the other. Somewhat similarly, the second elastic band 24 extends across the back of bootie 90, forming a U-shape, such that it extends from one side of the bootie 90 to the other. In aspects, the "open" ends of the two U-shapes converge and meet to form the substantially right angle. In exemplary aspects, the first and second elastic bands are the same width, with one exemplary width being 9 mm. However, the first and second bands could also have widths different from one another, and could vary in width. The first and second elastic bands 22 and 24 define a heel pocket 26 that is knit from a generally non-elastic yarn. In aspects, the heel pocket 26 is knit with an increased thickness for added comfort. When the heel pocket 26 is formed, a line is created called the gore line that runs diagonally through the heel, and is formed by stitches that are knit and other stitches that are held in position without stitching. In some aspects, heel area 20 further has a third elastic band 28 that extends into the heel pocket 26, generally along the gore line of the heel pocket 26. In aspects, the third elastic band 28 has a tapering width that terminates in a point Like first and second elastic bands 22, 24, third elastic band 28 may have an initial exemplary width of 9 mm that tapers to form a point, although other widths are within the scope of this disclosure. Additionally, although the third elastic band 28 is shown with a tapering width, other shapes could also be used. The third elastic band 28 could also be shorter, or longer, than the band 28 depicted in FIG. 9. Any of a number of elastomeric yarns could be used for first, second, and third elastic bands 22, 24, and 28, and different yarns could be used for each band, although in some aspects the same elastomeric yarn is used for all of bands 22, 24, and 28. Further, the elasticity of the bands 22, 24, and 28 merely needs to be greater than the elasticity of the heel pocket 26 and ankle region 18.

Elastic bands 22, 24, and 28 cooperate to properly position the heel area 20 of bootie 90 on the wearer's foot, and cooperate to retain the heel area 20 of the bootie 90 relative to the wearer's foot while the bootie is worn. In other words, the elastic bands 22, 24, and 28 aid in preventing the heel area 20 of bootie 90 from slipping relative to the wearer's heel. Bootie 90 could also be formed with any of the heel constructions shown and described with reference to FIGS. 5-8.

Bootie 90 further includes a foot region 30 that extends in the typical cylindrical fashion, terminating at an open area, as illustrated by the seam 42. The foot region 30 includes a top side 34 and a bottom side 36 oriented to surround the top and bottom of a wearer's foot, respectively. The top side 34 is formed with spaced elastic strips 38 separated by non-elastic bands 40. In one aspect, as shown, strips 38 and bands 40 are formed in spaced, parallel relationship. The term "elastic" is used here to define the relative elasticity between strips 38 having more elasticity than bands 40. In other words, while bands 40 may have some elasticity, the strips 38 are more elastic than bands 40. The separated areas of elasticity formed by strips 38 function to provide added traction to bootie 90 and aid in keeping the bootie 90 in place on the foot of the wearer.

Figure 10:
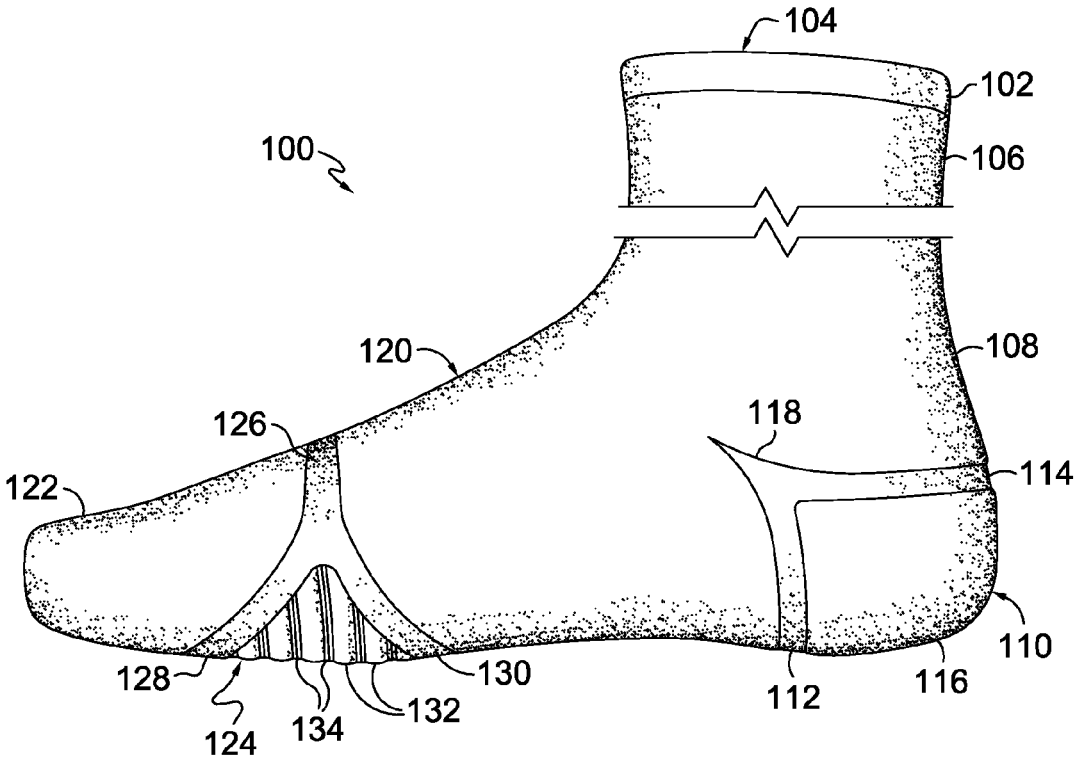
FIG. 10 shows a view similar to FIG. 2, but showing an alternative aspect.
Figure 11:
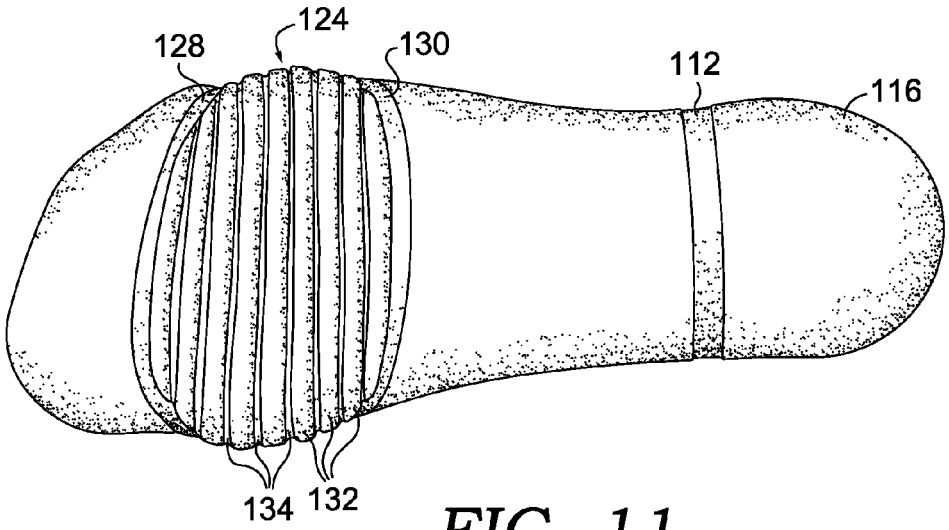
FIG. 11 is a bottom view of the construction of FIG. 10.

FIGS. 10 and 11 depict an alternative construction. The sock 100 shown in FIGS. 10 and 11 includes an upper cuff 102 that defines a circular opening 104, through which a user can insert her foot when donning the sock. A leg region 106 extends downwardly from the cuff 102, and an ankle region 108 extends below the leg region. Depending on the sock type, the leg region 106 varies in height. For example, for a boot length sock 100, the leg region 106 would extend higher than a crew length sock 100. In some aspects, the sock 100 can be made as a no-show sock, where the leg region 106 is omitted, and the sock transitions from the cuff 102 to the ankle region 108. Other sock types, such as, for example, quarter length and over-the-calf, are also possible, and this disclosure is not limited to any particular sock type.

Sock 100 includes a heel area 110 is shown. In this aspect, heel area 110 is defined by a first elastic band 112 that extends generally vertically from the bottom of sock 100, and a second elastic band 114 that extends from the back of the sock 100 horizontally. The first elastic band 112 extends across the bottom of the sock 100, forming a U-shape, such that it extends from one side of the sock 100 to the other. Somewhat similarly, the second elastic band 114 extends across the back of sock 100, forming a U-shape, such that it extends from one side of the sock 100 to the other. In this exemplary aspect, the "open" ends of the two U-shapes converge and meet at the terminal ends thereof. In exemplary aspects, the first and second elastic bands are the same width, with one exemplary width being 9 mm. However, the first and second bands could also have widths different from one another, and could vary in width. In exemplary aspects, first and second elastic bands 112 and 114 form more of an obtuse angle like that of FIG. 7 above. The first and second elastic bands 112 and 114 define a heel pocket 116 that is knit from a generally non-elastic yarn. In aspects, the heel pocket 116 is knit with an increased thickness for added comfort. Any of a number of elastomeric yarns could be used for first and second bands 112 and 114, and different yarns could be used for each. As with the aspects described above, the elasticity of the bands 112 and 114 merely needs to be greater than the elasticity of the heel pocket 116. In this exemplary aspect, heel area 110 further has a third elastic band 118 that extends away from the heel pocket 116, oriented generally in-line with the gore line of the heel pocket 116. In aspects, the third elastic band 118 has a tapering width that terminates in a point. Like first and second elastic bands 112 and 114, third elastic band 118 may have an initial exemplary width of 9 mm, although other widths are within the scope of this disclosure. Additionally, although the third elastic band 118 is shown with a tapering width, other shapes could also be used. The third elastic band 118 could also be shorter, or longer, than the band 118 depicted in FIG. 10. Any of a number of elastomeric yarns could be used for first, second, and third elastic bands 112, 114, and 118, and different yarns could be used for each band, although in some aspects the same elastomeric yarn is used for all of bands 112, 114, and 118. Further, the elasticity of the bands 112, 114, and 118 merely needs to be greater than the elasticity of the heel pocket 116. Other heel constructions, such as those in FIGS. 1-6, and 8 could also be used for heel area 110.

In addition to heel area 110, sock 100 has a forefoot locating feature 124 in the foot area 120, located rearwardly of a toe area 122. Locating feature 124 has an upper elastic band 126 that runs across the top of sock 100, and has lower elastic bands 128 and 130 that converge to elastic band 126 as shown in FIG. 10. The bands 126, 128 and 130 form an enclosed pocket that is knit with alternating, spaced elastic strips 134 separated by non-elastic bands 136. In one aspect, as shown, strips 134 and bands 136 are formed in spaced, parallel relationship. The term "elastic" is used here to define the relative elasticity between strips 134 having more elasticity than bands 136. In other words, while bands 136 may have some elasticity, the strips 134 are more elastic than bands 136. The separated areas of elasticity formed by strips 134, and the elastic bands 126, 128 and 130 function to provide added traction to sock 100 and aid in keeping the sock 100 in place on the foot of the wearer.

Figure 12:
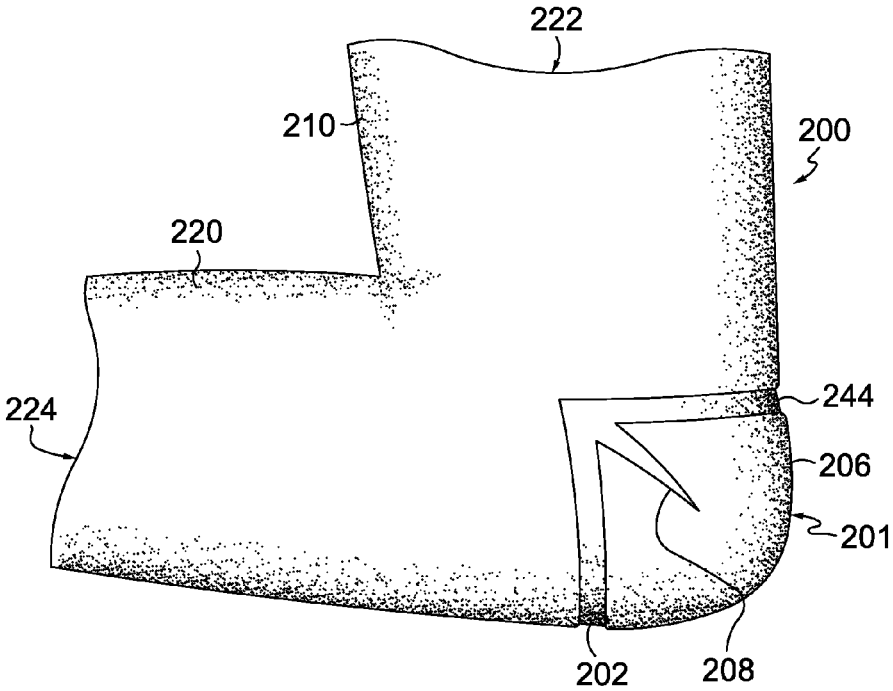
FIG. 12 shows a side view of an alternative aspect.

FIG. 12 depicts another alternative construction. FIG. 12 shows a sleeve type construction 200, having an upper end 210 and a lower end 220. Upper end 210 may extend to varying lengths and will terminate in an open end 222. Similarly, lower end 220 may extend to varying lengths and will terminate in an open end 224. Sleeve 200 could be constructed and sized for an arm or a leg. Sleeve 200 has a transition area 201 that corresponds to the elbow region (when sleeve 200 is formed as an arm sleeve) or the knee region (when sleeve 200 is formed as a leg sleeve). Transition area 201 is defined by a first elastic band 202 that extends generally vertically (as viewed in FIG. 12), and a second elastic band 204 that extends from the back of the sleeve 200 horizontally (as viewed in FIG. 12). In aspects, the first and second elastic bands meet and form a substantially right angle. The first elastic band 202 extends across the bottom of the sleeve 200, forming a U-shape, such that it extends from one side of the sleeve 200 to the other. Somewhat similarly, the second elastic band 204 extends across the back of sleeve 200, forming a U-shape, such that it extends from one side of the sleeve 200 to the other. In aspects, the "open" ends of the two U-shapes converge and meet to form the substantially right angle. In exemplary aspects, the first and second elastic bands are the same width, with one exemplary width being 9 mm. However, the first and second bands could also have widths different from one another, and could vary in width. The first and second elastic bands 202 and 204 define a pocket 206 that is knit from a generally non-elastic yarn. In aspects, the pocket 206 is knit with an increased thickness for added comfort. In some aspects, transition area 201 further has a third elastic band 208 that extends into the pocket 206, generally bisecting the angle formed by bands 202 and 204. In aspects, the third elastic band 208 has a tapering width that terminates in a point. Like first and second elastic bands 202, 204, third elastic band 208 may have an initial exemplary width of 9 mm that tapers to form a point, although other widths are within the scope of this disclosure. Additionally, although the third elastic band 208 is shown with a tapering width, other shapes could also be used. The third elastic band 28 could also be shorter, or longer, than the band 208 depicted in FIG. 12. Any of a number of elastomeric yarns could be used for first, second, and third elastic bands 202, 204, and 208, and different yarns could be used for each band, although in some aspects the same elastomeric yarn is used for all of bands 202, 204, and 208. Further, the elasticity of the bands 202, 204, and 208 merely needs to be greater than the elasticity of the pocket 206.

Elastic bands 202, 204, and 208 cooperate to properly position the transition area 201 of sleeve 200 relative to the wearer. When sleeve 200 is formed as an arm sleeve, transition area 201 operates to position transition area 201 in place relative to the wearer's elbow. Similarly, when sleeve 200 is formed as a leg sleeve, transition area 201 operates to position transition area 201 in place relative to the wearer's knee. Transition area 201 could also be formed with constructions similar to heel pockets 56, 66, 76 and 86 as shown and described with reference to FIGS. 5-8.

The non-elastic regions in any of the garments described above could be knit with a yarn designed to provide enhanced grip. These yarns may comprise yarns having a very small denier per filament (dpf). As an example, a typical microfiber yarn is around 1 dpf. For example, a 75 D microfiber yarn having 72 filaments/yarn results in a dpf of 75/72. In contrast, a suitable yarn having a very small dpf is the NANOFRONT® yarn available from Tejin. Such a suitable yarn may comprise, for example, 30D yarns with 8560 filaments per yarn, resulting in a dpf of 30/8560. To provide the gripping characteristics, the dpf should be less than 0.01. The resulting yarn has a very high surface area which may be used to increase grip in select regions of the garment.

From the foregoing, it will be seen that this invention is one well adapted to attain all the ends and objects hereinabove set forth together with other advantages which are obvious and which are inherent to the structure.

It will be understood that certain features and sub-combinations are of utility and may be employed without reference to other features and sub-combinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. A garment to be worn on the foot, comprising:

a foot area; and a heel area extending from the foot area and located to correspond to the heel of a foot when worn by a user, the heel area comprising an elastic border that surrounds a heel pocket that is less elastic than the elastic border, the elastic border including a first elastic band extending vertically upward from a bottom of the sock and having a first terminal end and a second terminal end, and a second elastic band extending horizontally inward from the back of the sock and oriented perpendicular to the first elastic band and having a first terminal end and a second terminal end, the first terminal end of the first elastic band and the first terminal end of the second elastic band forming a right angle, and the second terminal end of the first elastic band and the second terminal end of the second elastic band forming a right angle.

2. The garment of claim 1, further comprising a third elastic band with a first end located at, and extending from, the intersection of the first and second elastic bands, and a second end extending away from said first end further into the heel area.

3. The garment of claim 2, wherein the third band extends at an angle bisecting the angle formed by the first and second elastic bands.

4. The garment of claim 3, further comprising, a series of parallel, spaced elastic strips formed on the bottom of the sock in the foot area, the elastic strips separated by a series of parallel, spaced non-elastic bands.

5. The garment of claim 4, wherein at least some of the spaced elastic strips extend from the bottom of the sock in the foot area to the top of the sock in the foot area.

6. The garment of claim 1, further comprising a third elastic band with a first end located at the intersection of the first and second elastic bands, and a second end extending away from said first end away from the heel area.

7. The garment of claim 6, wherein the third elastic band extends from one side of the sock to the other, extending from the intersection of the first and second elastic bands on one side of the sock to the intersection of the first and second elastic bands on the other side of the sock.

8. The garment of claim 6, wherein the third elastic band tapers to a terminating point on each side of the sock.

9. A knit garment with locating features, comprising:

a first knit area;

a second knit area spaced from the first area;

a first knit locating feature disposed between the first knit area and the second knit area, the locating feature being defined by an elastic border that surrounds a less-elastic first knit pocket, the elastic border including a first elastic band extending vertically upward from a bottom of the sock, and a second elastic band extending horizontally inward from the back of the sock and oriented perpendicular to the first elastic band, such that the first and second elastic bands meet at terminating ends thereof to form a right angle.

10. The knit garment of claim 9, wherein the garment is configured to be worn as an arm sleeve, and the first knit locating feature is located to correspond to the elbow region when worn.

11. The knit garment of claim 9, wherein the garment is configured to be worn as a leg sleeve, and the first knit locating feature is located to correspond to the knee region when worn.

12. The knit garment of claim 9, wherein the garment is configured as a sock, and the first knit locating feature is located to correspond to the heel region when worn.

13. The garment of claim 12, further comprising a third elastic band with a first end located at the intersection of the first and second elastic bands, and a second end extending away from said first end further into the first knit pocket.

14. The garment of claim 13, further comprising a second knit locating feature defined by an elastic border that surrounds a less-elastic second knit pocket.

15. The garment of claim 14, wherein the less-elastic second knit pocket is knit from yarn having a denier per filament less than 0.01.

16. A garment to be worn on the foot, comprising:

a foot area;

a heel area extending from the foot area and located to correspond to the heel of a foot when worn by a user, the heel area comprising:

an elastic border that surrounds a heel pocket that is less elastic than the elastic border, the elastic border including a first elastic band extending vertically upward from a bottom of the sock, a second elastic band extending horizontally inward from the back of the sock and oriented perpendicular to the first elastic band such that the first and second elastic bands meet at terminating ends thereof to form a right angle, and a third elastic band with a first end located at, and extending from, the intersection of the first and second elastic bands, and a second end extending away from said first end further into the heel area.

17. The garment of claim 16, wherein the third band extends at an angle bisecting the angle formed by the first and second elastic bands.

18. The garment of claim 17, further comprising, a series of parallel, spaced elastic strips formed on the bottom of the sock in the foot area, the elastic strips separated by a series of parallel, spaced non-elastic bands.

19. The garment of claim 17, wherein the second end of the third elastic band terminates at a point in the heel area.

* * * * *